United States Patent [19]

Dotson et al.

[11] Patent Number: 4,968,394

[45] Date of Patent: Nov. 6, 1990

[54] METHOD OF REDUCING EXCESS NITRIC ACID IN AQUEOUS HYDROXYLAMINE NITRATE SOLUTIONS

[75] Inventors: Ronald L. Dotson, Cheshire, Conn.; Debra Y. Hernandez, Boston, Mass.; Ronald A. Sasse, Baltimore, Md.

[73] Assignee: Olin Corporation, Cheshire, Conn.

[21] Appl. No.: 375,766

[22] Filed: Jul. 5, 1989

Related U.S. Application Data

[60] Division of Ser. No. 117,711, Nov. 5, 1987, Pat. No. 4,849,073, and a continuation-in-part of Ser. No. 896,684, Aug. 15, 1986, abandoned.

[51] Int. Cl.[5] ..... C25B 1/00; B01J 41/00; C01B 21/087

[52] U.S. Cl. ..... 204/101; 210/683; 423/387; 423/395

[58] Field of Search ..... 423/387, 395; 210/683; 204/101

[56] References Cited

U.S. PATENT DOCUMENTS

| | | | |
|---|---|---|---|
| 727,025 | 5/1903 | Tafel | 204/101 |
| 2,208,173 | 4/1939 | Urbain et al. | 423/395 |
| 2,242,477 | 5/1941 | Osswald et al. | 204/101 |
| 4,147,623 | 4/1979 | Koff et al. | 423/387 |
| 4,387,082 | 6/1983 | Grosskinsky et al. | 423/387 |

OTHER PUBLICATIONS

Chem. Abs. 44/6751e; Lazzari, Giacomo, *Proc. Intern. Congr. Pure and Applied Chem.*, "The Electrolytic Preparation of Hydroxylamine", (London) 11, 177–88 (1947; in Italian).

Chem. Abs. 68/43114v; Masek, J., *Fresenius' Z. Anal. Chem.*, "Polarographic Reduction of the NO° Group", 224 (1), 99–107 (1967) (English).

Chem. Abs. 75/14187b; Savodnik, N. N., Shepelin, V. A., Zalkind, Ts. I., *Elektrokhimiya*, "Synthesis of Hydroxylamine on Platinum. I. Electrochemical Reduction of Nitric Oxide on a Platinum Electrode", 1971, 7(3), 424–7 (Russ.).

Chem. Abs. 75/14188c; Savodnik, N. N.; Shepelin, V. A.; Zalkind, Ts. I., *Elektrokhimiya*, "Synthesis of Hydroxylamine on Platinum. II. Interaction of Nitric Oxide and Hydrogen on Platinum", 1971, 7 (4), 583–5 (Russ.).

Chem. Abs. 80/151993d; Shepelin, V. A., *Zh. Prikl. Khim. (Leningrad)*, "Selection of a Model for a New Method of Hydroxylamine Preparation", 1974, 47 (4), 713–16 (Russ.).

Chem. Abs. 86/48482m; J. J. L. Janssen, *Electrochim. Acta*, "Reduction of Nitric Oxide at a Flow-Through Mercury Plated Nickel Electrode", 1976, 21 (10), 811–15 (Eng.).

Bathia, M. L., and A. P. Watkinson, *The Canadian Journal of Chemical Engineering*, "Hydroxylamine Production by Electroreduction of Nitric Oxide in a Trickle Bed", vol. 57, Oct., 1979, pp. 631–637.

Chem. Abs. 75/29394r; Savodnik, N. N. et al., *USSR* 292,887, "Hydroxylamine", Jan. 15, 1971.

Morrison & Boyd, *Organic Chemistry*, 1980 (3rd Ed.) p. 640.

*Primary Examiner*—John F. Niebling
*Assistant Examiner*—David G. Ryser
*Attorney, Agent, or Firm*—James B. Haglind

[57] ABSTRACT

A process for reducing excess nitric acid in an aqueous hydroxylamine nitrate solution. The process is conducted by reacting the aqueous hydroxylamine nitrate solution with a basic neutralizing agent such as nitric oxide, hydroxylamine vapor or a mixture thereof or by contacting the aqueous hydroxylamine nitrate solution with an anion exchange resin having a pKa in the range of from about 5 to about 9. The aqueous hydroxylamine nitrate solution may be produced by the electrolysis of nitric acid.

11 Claims, 1 Drawing Sheet

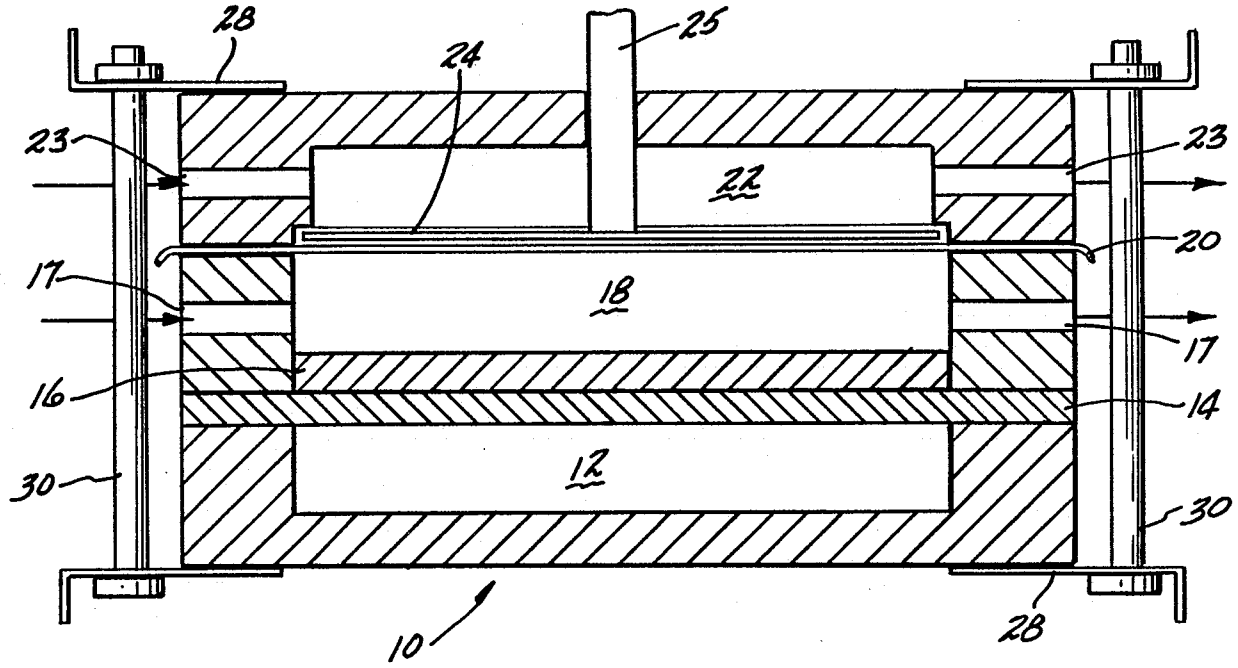
23
20
17
14
30
28
22
25
18
12
24
10
28
23
17
16
30

METHOD OF REDUCING EXCESS NITRIC ACID IN AQUEOUS HYDROXYLAMINE NITRATE SOLUTIONS

STATEMENT AS TO RIGHTS TO INVENTIONS MADE UNDER FEDERALLY-SPONSORED RESEARCH AND DEVELOPMENT

The U.S. Government has rights in this invention pursuant to Contract No. DAAAK15-85-C-0001 phase O and Contract No. DAAA15-87 awarded by the Department of Army. Under these contracts, the U.S. Government has certain rights to practice or have practiced on its behalf the invention claimed herein without payment of royalties.

CROSS-REFERENCES TO RELATED APPLICATIONS

This application is a division of application Ser. No. 07/117,711, filed Nov. 5, 1987, now U.S. Pat. No. 4,849,073. Also this application is a Continuation-in-part of U.S. Ser. No. 896,684, filed Aug. 15, 1986, now abandoned.

BACKGROUND OF THE INVENTION

The present invention relates to an electrochemical process for the production of aqueous solutions of hydroxylamine compounds. More particularly, the present invention relates to the electrochemical production of aqueous solutions of hydroxylamine nitrate.

Hydroxylamine nitrate is employed in the purification of plutonium metal, as one component of a liquid propellant, and as a reducing agent in photographic applications. In some of these applications a highly pure form of the compound is required.

Previous electrolytic processes have electrolyzed nitric acid solutions containing mineral acids such as sulfuric acid or hydrochloric acid to form hydroxylamine salts of these acids. The processes were carried out in an electrolytic cell having high hydrogen overvoltage cathodes such as mercury or an alkali metal amalgam and a diaphragm separating the cathode from the anode.

The hydroxylamine salt produced by the electrolytic processes of the prior art can be converted to hydroxylamine nitrate at low solution strength and in an impure state. One method is by electodialysis as taught by Y. Chang and H. P. Gregor in Ind. Eng. Chem. Process Des. Dev. 20, 361–366 (1981). The double displacement reaction employed requires an electro-chemical cell having a plurality of compartments and requiring both anion exchange and cation exchange membranes or bipolar membranes with significant capital costs and high energy costs.

There is a need for an electrolytic process for directly producing hydroxylamine nitrate in the absence of other salts. Further, there is a need for a process for producing hydroxylamine nitrate having reduced capital and energy costs.

SUMMARY OF THE INVENTION

It is an object of the present invention to provide an electrolytic process for the direct production of stable solutions of hydroxylamine nitrate.

Another object of the invention is to provide a process for the production of very high purity solutions of hydroxylamine nitrate.

A further object of the present invention is to provide a process for producing hydroxylamine nitrate at reduced capital, energy, and operating costs.

These and other objects of the invention are accomplished in a process for electrolytically producing a solution of hydroxylamine nitrate in an electro-chemical cell having a cathode compartment, an anode compartment, and a separator between the cathode compartment and the anode compartment, which process comprises:

(a) feeding a catholyte consisting essentially of an aqueous nitric acid solution to the cathode compartment, (b) feeding an anolyte to the anode compartment, (c) electrolyzing the catholyte while maintaining the cathodic reaction temperature below about 50° C. to produce a hydroxylamine nitrate solution, and (d) recovering the hydroxylamine nitrate solution from the cathode compartment.

BRIEF DESCRIPTION OF THE DRAWING

The FIGURE illustrates a schematic cross sectional view of an electrolytic cell suitable for use with the novel process of the present invention.

In the FIGURE electrolytic cell 10 includes cathode compartment 18 and anode compartment 22 which are separated by separator 20. Cathode compartment 18 has mercury-containing cathode 16 which is positioned on conductive plate 14. Cathode compartment 18 has inlets and outlets 17 for recirculation of the aqueous nitric acid solution. Plate 14 also serves as the top of cooling compartment 12. Cathode current conductor (not shown) is connected to plate 14. Cooling compartment 12 has inlets and outlets (not shown) for introducing and removing the coolant. Products produced in cathode compartment 18 are removed through outlet 17. Anode compartment 22 contains anode 24 and inlets and outlets 23 for introducing and removing the anolyte. Anode current conductor 25 is connected to anode 24. Clamping frames 28 and clamps 30 provide compression and support for electrolytic cell 10.

DESCRIPTION OF THE PREFERRED EMBODIMENTS

In more detail, in the novel process of the present invention an aqueous solution of nitric acid is fed to the cathode compartment of an electrolytic cell. The aqueous solution may contain any concentration of $HNO_3$ which is suitable for electrolysis to produce hydroxylamine nitrate. As nitric acid is a strong oxidizing agent, the solution as a catholyte in the cathode compartment should have a uniform or homogeneous concentration so that localized pH gradients can be controlled and high $NO_3^-$ levels do not lead to oxidation of the product. The catholyte solution is essentially free of other mineral acids such as hydrochloric acid or sulfuric acid.

During electrolysis, the desired reactions at the cathode are thought to be as given in the following equations:

$$HNO_3+2H^++2e^-\rightarrow HNO_2+H_2O \quad (1)$$

$$HNO_2+4H^++4e^-\rightarrow NH_2OH+H_2O \quad (2)$$

(1) and (2) being summarized by:

$$HNO_3+6H^++6e^-\rightarrow NH_2OH+2H_2O \quad (3)$$

Hydroxylamine ($NH_2OH$) produced is then protonated for stabilization with $HNO_3$: according to the equation:

$$HNO_3+NH_2OH=NH_2OH.HNO_3 \quad (4)$$

While equations (3) and (4) are believed to indicate the stoichiometric amounts of nitric acid required to produce hydroxylamine nitrate during operation of the electrolytic process, an excess amount of nitric acid in the catholyte is maintained which is from about 0.1 to about 1.2, preferably from about 0.1 to about 0.8, and more preferably from about 0.2 to about 0.5 moles per liter.

In a preferred embodiment, the catholyte solution is continuously removed from and recirculated to the cathode compartment following the supplemental addition of $HNO_3$ required to maintain the concentrations given above.

The catholyte solution temperature in the cathode chamber is maintained at below about 50° C., for example, in the range of from about 5° to about 40° C., and preferably at from about 15° to about 30° C. Cooling may be provided by any suitable means including cooling the cathode support plate as shown in the FIGURE, or directly cooling the catholyte or the cathode, for example, where mercury is the cathode material.

If the temperature of the catholyte is above about 50° C. or if oxygen is present in the catholyte, undesired formation of by-products such as nitrogen oxide, ammonia or nitrogen dioxide may occur, as represented by the equations:

$$NH_2OH.HNO_3 \longrightarrow 2NO + 2H_2O \quad (5a)$$

$$3NH_2OH \xrightarrow{\text{alkaline}} NH_3 + N_2 + 3H_2O \quad (5b)$$

$$4NH_2OH \xrightarrow{\text{acidic}} 2NH_3 + N_2O + 3H_2O \quad (5c)$$

Operation of the novel process of the present invention is carried out in a manner which prevents the evolution of significant amounts of hydrogen gas. A preferred way, according to the invention, is to control the cathode half-cell potential. Suitable cathode half-cell potentials are those at about or below the hydrogen overvoltage for the cathode employed, for example, half-cell potentials in the range of from about −0.5 to about −3 volts versus a standard calomel electrode. Preferred cathode half-cell potentials are those in the range of from about −0.8 to about −2, and more preferably from about −1 to about −1.5.

When using a mercury cathode at half-cell potentials above about 3 volts, hydroxylamine nitrate may be reduced to ammonium nitrate according to the equation:

$$NH_2OH.HNO_3+2H^++2e^-\rightarrow NH_4^++NO_3^-+H_2O \quad (6)$$

The actual hydrogen overpotential of a cathode depends on many factors including current density, local pH gradient, temperature, the concentration gradients of the catholyte, and particulary in using mercury cathodes, on the degree of contamination of the mercury surface with metal impurities. In view of these various factors, and while the generation of hydrogen also results in the production of $OH^-$ ion which can decompose hydroxylamine nitrate, some generation of hydrogen gas can be tolerated in the process of the present invention.

The anolyte is an aqueous mineral acid solution capable of supplying protons to the catholyte. Suitable mineral acids include nitric acid, hydrochloric acid, phosphoric acid, sulfuric acid, perchloric acid, boric acid, and mixtures thereof. Preferred as an anolyte is a nitric acid solution as it will not introduce undesired impurities into the catholyte. Where the purity of the hydroxylamine nitrate product is not critical, other acids such as hydrochloric or sulfuric may be used as the anolyte providing they do not introduce sufficient amounts of the anion into the catholyte solution to form the corresponding hydroxylamine salt. Concentrations of the acid in the anolyte are not critical and any suitable concentrations may be used. It is advantageous to maintain the concentration of the anolyte solution higher than the concentration of the nitric acid solution catholyte to prevent dilution with water of the catholyte. For example, it is desirable to maintain a ratio of the molar concentration of the anolyte to that of the excess nitric acid in the catholyte of at least 2 and preferably from about 6 to about 15. The anolyte is preferably continuously removed from and recirculated to the anode compartment with the concentration of the acid being adjusted as required.

The novel process of the present invention is operated at current densities suitable for producing concentrated solutions of hydroxylamine nitrate. For example, suitable cathode current densities include those in the range of from about 0.05 to about 2, preferably from about 0.2 to about 1 kiloamperes per square meter.

Hydroxylamine nitrate solutions produced by the process of the present invention are of high purity. Hydroxylamine nitrate is, however, less stable than other hydroxylamine salts particularly at high temperatures. It is particularly important where the product solutions are to be concentrated, for example, for use in a propellant, to carefully control the concentration of excess nitric acid in the product solution. This can be accomplished in one of several ways.

In one embodiment, a nitrogen oxide, such as nitric oxide (NO), is admixed with the catholyte product solution to form hydroxylamine nitrate while reducing the amount of excess nitric acid according to the following equations:

$$NO+3H^++3e^-\rightarrow NH_2OH \quad (7)$$

$$HNO_3+NH_2OH\rightarrow NH_2OH.HNO_3 \quad (8)$$

$$NO+3H^++3e^-+HNO_3\rightarrow NH_2H.HNO_3 \quad (9)$$

In an alternate embodiment, hydroxylamine vapor may be admixed with the product solution to convert the excess nitric acid to hydroxylamine nitrate in a gas phase titration reaction represented by equation (4) above.

One suitable means for introducing hydroxylamine vapor is to neutralize a portion of the hydroxylamine nitrate solution produced by the novel process of the present invention. A portion of the hydroxylamine nitrate solution is fed to a reaction vessel to which a basic neutralizing agent such as liquid ammonia is added. The neutralization reaction is maintained at very low temperatures, for example, those below 0° C. The liquid ammonia is distilled off leaving the hydroxylamine free base. The hydroxylamine produced is then directly distilled under vacuum or admixed with an alcohol such as methanol or ethanol and distilled. The gaseous mixture formed containing hydroxylamine vapor is then fed to a second reaction vessel to admix with the hydroxylamine nitrate solution and thereby convert excess nitric acid present in the solution to additional hydroxylamine nitrate. Hydroxylamine vapor may also be generated by the ammonolysis of a hydroxylamine salt such as hydroxylamine sulfate or hydroxylamine chloride with liquid ammonia.

Excess nitric acid in the hydroxylamine nitrate catholyte product solution can also be reduced in a preferred embodiment by contacting the solution with a basic anion exchange resin. Suitable anion exchange resins are those which neutralize the excess nitric acid present without decomposing or with minimal decomposition of, the hydroxylamine nitrate product. For example, quite suitable are anion exchange resins having a pKa in the range of about 5 to 9 and preferably having Lewis base functional groups which do not provide hydroxyl ions. Suitable anion exchange resins include AMBERLITE® IRA-410, AMBERLITE® IR-4B, and AMBERLITE® IR-45 (products of Rohm & Haas); DOWEX®-2 and DOWEX® 3 (products of Dow Chemical); DUOLITE® A-40, DUOLITE® A-7, and DUOLITE® A-14 (products of Chemical Process Co.); NALCITE® SAR and NALCITE® WBR (a product of Nalco Chemical Co.) and ZEROLIT® G (a product of Permutite Co.) among others.

This method eliminates the need for producing or handling liquid hydroxylamine as the free base.

Following neutralization, where the hydroxylamine nitrate product solution is to be used in propellant products, the concentration of excess nitric acid should be below about 0.1 mole per liter, and preferably below about 0.05 mole per liter as indicated, for example, by a pH in the range of from about 1 to about 1.6, and more preferably from about 1.4 to about 1.5.

The electrolytic cell employed in the novel process of the present invention includes a cathode having a high hydrogen overvoltage and a separator between the anode and the cathode. Suitable cathode materials are those which efficiently promote the reduction reaction while preventing or minimizing the introduction of impurities into the hydroxylamine nitrate solutions. Suitable cathode materials include liquid metals such as mercury and mercury-containing materials such as alkali metal amalgams and amalgamated lead, and gallium, and mixtures thereof, with mercury being preferred. In addition, solid cathodes of metals having high hydrogen overvoltages may be employed such as cadmium, tin, lead, zinc, indium, and thallium and mixtures thereof. The purity of the cathode material is important in preventing any decomposition of the hydroxylamine nitrate product. Cell components, particularly those in the cathode compartment should be made from materials which are resistant to the acidic catholyte solution. Contamination of the cathode and catholyte solution with metals such as copper, iron, and platinum group metals should be avoided. Further, purification of the mercury in a mercury-containing cathode may be desirable. Suitable mercury purification methods include cleaning with ammonia-containing solutions and distillation, among others.

Separators which may be employed in the electrolytic cell include those which prevent or minimize the passage of gases, anions, or excessive amounts of water from the anode compartment into the cathode compartment. Suitable as separators include chemically stable cation exchange membranes battery separators.

Cation exchange membranes selected are those which are inert, flexible membranes, and are substantially impervious to the hydrodynamic flow of the electrolyte and the passage of any gas products produced in the anode compartment. Cation exchange membranes are well-known to contain fixed anionic groups that permit intrusion and exchange of cations, and exclude anions, from an external source. Generally the resinous membrane or diaphragm has as a matrix, a cross-linked polymer, to which are attached charged radicals such as $—SO_3^{=}$ and mixtures thereof with $—COOH^-$. The resins which can be used to produce the membranes include, for example, fluorocarbons, vinyl compounds, polyolefins, and copolymers thereof. Preferred are cation exchange membranes such as those comprised of fluorocarbon polymers having a plurality of pendant sulfonic acid groups or carboxylic acid groups or mixtures of sulfonic acid groups and carboxylic acid groups and membranes of vinyl compounds such as divinyl benzene. The terms "sulfonic acid group" and "carboxylic acid groups" are meant to include salts of sulfonic acid or salts of carboxylic acid groups by processes such as hydrolysis.

More preferred are perfluorosulfonic acid membranes which are homogeneous structures, i.e., single layered membranes of fluorocarbon polymers having a plurality of pendant sulfonic acid groups.

Suitable cation exchange membranes are sold commercially by Ionics, Inc., by Dow Chemical Co., by E. I. DuPont de Nemours & Co., Inc., under the trademark "NAFION®", and by the Asahi Chemical Company under the trademark "ACIPLEX®".

Suitable anodes employed in the novel electro-chemical process for the production of hydroxylamine nitrate include, for example, platinum group metals such as platinum, ruthenium, niobium, or iridium, valve metals coated with platinum group metals or compounds <, thereof, high purity graphite, or EBONEX®.

The novel process of the present invention directly produces highly concentrated hydroxylamine nitrate solutions of high purity, i.e., suitable for use in a monopropellant.

The following examples illustrate the process of the invention without any intention of being limited thereby.

EXAMPLE 1

An electrolytic cell was employed having as the cathode a layer of mercury. The cathode covered the HASTELLOY® C top of a cooling chamber through which was circulated a glycol solution as a cooling agent. A perfluorosulfonic acid cation exchange membrane (NAFION® 117, a product of E. I. DuPont de Nemours and Co., Inc.) was positioned above and spaced apart from the mercury. The membrane was sloped downward at about 10° from the back of the cell to the front of the cell to facilitate gas release from the cathode compartment. The anode, platinum coated niobium, was positioned above the membrane. Commercial grade concentrated nitric acid (13M) was continuously fed to the cathode compartment and blended with the catholyte solution to provide an excess of $HNO_3$ acid. Dilute nitric acid (1M) was fed to the anode compartment as the anolyte. During electrolysis, the temperature of the cathode was maintained at an average temperature of 25° C. Electrolysis was conducted at a cathode half-cell voltage in the range of −0.7 to −1.2 vs SCE (Standard Calomel Electrode) at an average cathode current density of 0.4 $KA/m^2$ to produce an aqueous solution of hydroxylamine nitrate (HAN) having a final concentration of 4.2 m/l and containing excess nitric acid in the range of 0.5 to 1.3 m/l. The cell current efficiency averaged 67 percent with the cell in operation for 981 amp. hrs. The hydroxylamine nitrate solution contained 39 percent by weight of $NH_2OH.HNO_3$.

EXAMPLE 2

The procedure of EXAMPLE 1 was employed in the electrolytic cell of EXAMPLE 1 with the exception that the cation exchange membrane employed was NAFION® 324 (a product of E. I. DuPont de Nemours & Co., Inc.). An aqueous solution (2.18 molar) of hydroxylamine nitrate was produced.

EXAMPLE 3

The process of EXAMPLE 1 was operated in the electrolytic cell of the FIGURE employing a DuPont Nafion® 427 cation exchange membrane. The concentration of nitric acid in the anolyte was maintained at about 6 m/l. The concentration of excess nitric acid in the catholyte solution was maintained at about 0.6 m/l with the temperature at 15° C. A solution of 3.055 m/l of hydroxylamine nitrate was produced at a total cell voltage of 4.0 volts and current efficiency of about 70 percent. The solution was continuously fed to a column containing DOWEX® MWA-1 anion exchange resin to neutralize the excess nitric acid present. The hydroxylamine nitrate solution product removed from the column had a pH of 1.43. No excess concentration of nitric acid could be detected by titration of the solution with sodium hydroxide.

EXAMPLE 4

The process of EXAMPLE 3 was operated exactly using as the perfluorosulfonic acid cation exchange membrane NX-430 (a product of Dow Chemical Co.). The anolyte was a 5 m nitric acid solution and the excess nitric acid concentration in the catholyte was 0.6 m. The cell operated at a total cell voltage of 4.8 volts of which the cathode half cell potential was −1.45 volts. The current efficiency was 78 percent. After neutralization, the pH of the hydroxylamine nitrate product solution was 1.45.

What is claimed is:

1. A process for reducing excess nitric acid in an aqueous hydroxylamine nitrate solution having a concentration of $HNO_3$ greater than 0.1 mole per liter of hydroxylamine nitrate, the process which comprises reacting the aqueous hydroxylamine nitrate solution with a basic neutralizing agent.

2. The process of claim 1 in which the basic neutralizing agent is a nitrogen oxide, hydroxylamine vapor or a mixture thereof.

3. The process of claim 2 in which the nitrogen oxide is nitric oxide.

4. The process of claim 2 in which the basic neutralizing agent is hydroxylamine vapor.

5. The process of claim 4 in which the hydroxylamine vapor is produced by reacting liquid ammonia with a hydroxylamine salt.

6. The process of claim 5 in which the hydroxylamine salt is hydroxylamine nitrate.

7. The process of claim 5 in which the hydroxylamine salt is hydroxylamine sulfate or hydroxylamine chloride.

8. The process of claim 1 in which the excess nitric acid after reaction with the basic neutralizing agent is less than 0.1 mole per liter of hydroxylamine nitrate.

9. The process of claim 1 in which the pH of the hydroxylamine nitrate solution after reaction with the basic neutralizing agent in in the range of from about 1 to about 1.6.

10. The process of claim 1 in which the aqueous solution of hydroxylamine nitrate is produced by the electrolysis of nitric acid.

11. A process for reducing excess nitric acid in an aqueous hydroxylamine nitrate solution containing an excess of nitric acid which comprises contacting the aqueous hydroxylamine nitrate solution with an anion exchange resin having a pKa in the range of from about 5 to about 9.

* * * * *